United States Patent [19]

Diggs

[11] 4,096,952

[45] Jun. 27, 1978

[54] ADJUSTABLE JIB CRANE

[76] Inventor: Richard E. Diggs, 12A Rd., Carthage, Mo. 64836

[21] Appl. No.: 752,869

[22] Filed: Dec. 21, 1976

[51] Int. Cl.[2] ..... B66C 23/06

[52] U.S. Cl. ..... 212/56; 248/354 S

[58] Field of Search ..... 214/75 H; 212/61–70, 212/56; 403/104, 108, 287; 248/354 S, 354 P

[56] References Cited

U.S. PATENT DOCUMENTS

| | | | |
|---|---|---|---|
| 1,584,117 | 5/1926 | Mitchell | 212/61 |
| 2,777,660 | 1/1957 | Albrecht | 248/354 P |
| 2,862,628 | 12/1958 | Coates et al. | 214/75 H |
| 2,877,905 | 3/1959 | Wiley | 212/63 |
| 3,822,850 | 7/1974 | Elias | 248/354 S |

FOREIGN PATENT DOCUMENTS

| | | | |
|---|---|---|---|
| 394,418 | 6/1933 | United Kingdom | 212/61 |

*Primary Examiner*—Lawrence J. Oresky

*Attorney, Agent, or Firm*—Shoemaker and Mattare, Ltd.

[57] ABSTRACT

A jib crane having an adjustable height. The crane comprises a sectional mast which can be lengthened or shortened. The mast has a ceiling connecting element which can accommodate sloping ceilings, and a floor mounting element which is quickly and easily installed. A height adjuster connects the mast sections together.

20 Claims, 8 Drawing Figures

ADJUSTABLE JIB CRANE

BACKGROUND OF THE INVENTION

The present invention relates to material handling, and more particularly, to cranes for handling materials.

Many repair shops utilize cranes for hoisting and moving heavy equipment from one location to another. Heretofore, free-standing cranes have been used to perform this function. These cranes require special foundations and are very expensive to install, and consequently, are expensive and are not amenable to installation in a wide variety of buildings.

For example, present cranes must be custom fit for special locations if the building has a sloping roof, and once installed, cannot be moved without a complete and difficult re-installation procedure.

Examples of cranes known in the prior art are disclosed in U.S. Pat. Nos. 3,358,849 and 2,877,905. Neither of these cranes can be adjusted to compensate for varying building heights if the cranes are to be moved after installation. Accordingly, installation, and/or re-installation, is very expensive and time consuming.

The present invention enables a crane to be moved and relocated easily and quickly even after installation.

SUMMARY OF THE INVENTION

The crane embodying the teachings of the present invention has the height thereof easily adjusted to accommodate any building height.

The crane comprises a sectional mast which includes a lower section mounted on the floor of the building, and an upper section connected to the ceiling of the building. A height adjustment means connects the two mast sections together, and the lower section is telescopingly received within the upper section. The ceiling connecting element can be canted from the normal to accommodate a sloping roof, or it can be spherical to permit universal movement of the mast about the longitudinal centerline thereof.

The height adjusting means has radially directed holes therein which cooperate with like holes defined in the lower mast section for making height adjustments.

The adjustment means also includes bolts and nuts for making fine height adjustments.

In the preferred embodiment, the ceiling connecting element has grease grooves defined thereon which cooperate with similar grooves defined in the mast so that lubrication of the top bearing point can be maintained over long periods and all the weight of the structure is on the bottom bearing or base element.

Installation of the crane embodying the teachings of the present invention is therefore very easy, as the height of the crane is easily adjusted according to building ceiling height.

Movement of the crane from one position to another is also quite easy due to the ease with which the height thereof can be adjusted, thereby enabling the crane to be accommodated in buildings with varying floor to ceiling heights. Furthermore, due to the canted ceiling element, sloping roofs pose no problem to installation of the crane, and any type of roof element can be used as the ceiling mounting element is amenable to any shape, or slope, of roof element.

Leveling of the crane is also quite simple, due to the adjustment means and the ceiling elements.

Therefore, overall installation and maintenance costs for a crane embodying the teachings of the present invention are considerably reduced from those costs in cranes constructed according to the teachings of the prior art.

OBJECTS OF THE INVENTION

It is, therefore, a main object of the present invention to provide a crane which is easily installed.

It is another object of the present invention to provide a crane having the height thereof easily adjusted.

It is a further object of the present invention to provide a crane which can be connected to a sloping roof.

It is yet another object of the present invention to provide a crane which is easily moved from one position to another.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
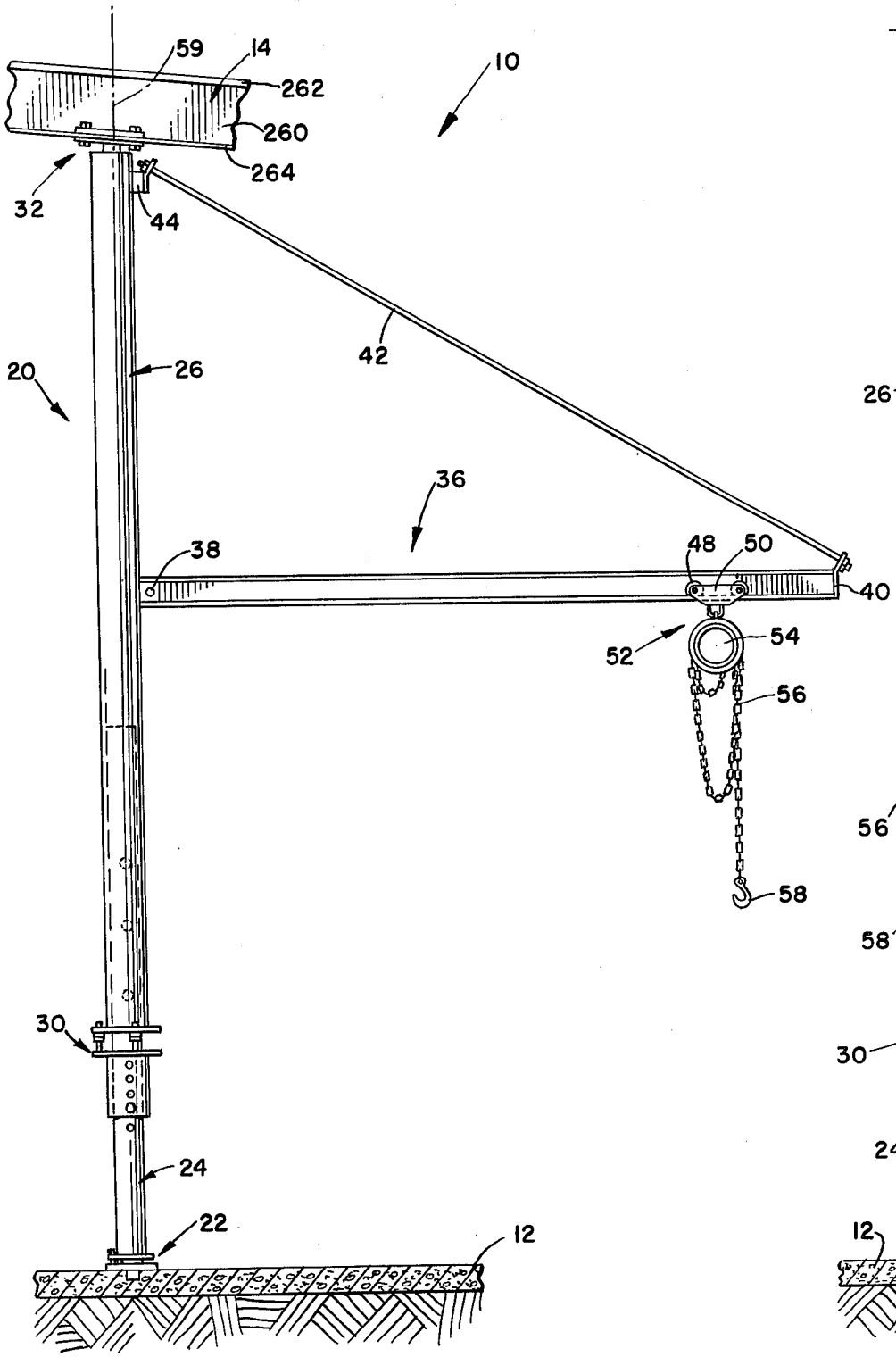
FIG. 1 is a side elevation of the crane embodying the teachings of the present invention.
Figure 2:
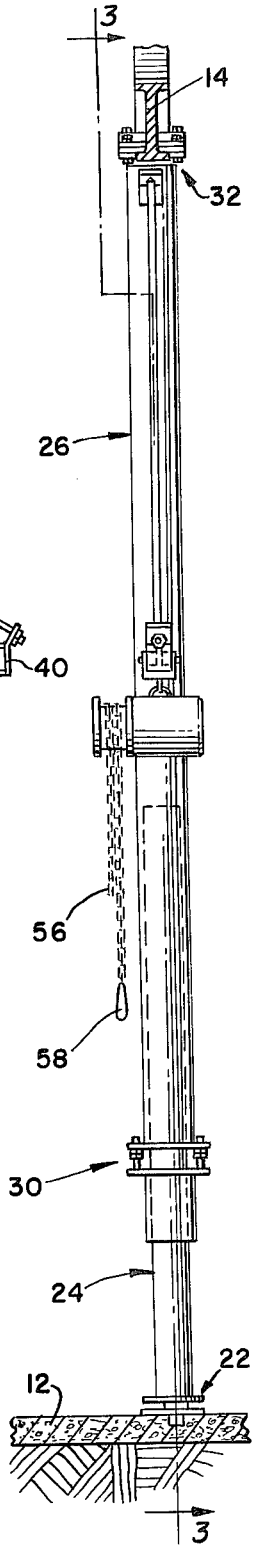
FIG. 2 is an end elevation of the crane embodying the teachings of the present invention.

Shown in FIG. 1 is a jib crane embodying the teachings of the present invention. The crane is generally denoted by the numeral 10 and is supported at the bottom on a floor 12 and at the top by a ceiling element, such as a ceiling beam 14.

In general, the crane comprises a sectional mast 20 which is supported to be plumb, or truly vertical, by a base element 22 connected to a bottom section 24 of the mast. The bottom section is generally tubular and is telescopingly received in an upper tubular section 26 of the mast, and is connected thereto by an adjustment member 30. A top element 32 connects the upper mast section to the ceiling beam.

A horizontally extending cantilever boom 36 is secured at one end thereof to the mast upper section by a bracket 38 and has a bracket 40 on the outer end thereof. A tie rod 42 is connected at one end thereof to bracket 40 and at the other end thereof to the mast upper section 26 by a bracket 44 located at or near the top of the mast. The tie rod acts as a tension brace and can include screw threads which cooperate with complemental threads in the brackets 40 and 44 or with nuts to attach the tie rod to the mast to form a triangular structure with the boom 36, as shown in FIG. 1. The boom 36 is of the usual girder construction and cross-section and has thereon a trackway on which wheels 48 of carriage 50 of a trolley device 52 ride. The trolley device is supported for translational movement on the girder, and includes a hoist mechanism connected to a hoist pulley 54 around which is trained a chain 56 having a hook 58 thereon. Other devices can be substituted for the hoisting mechanism, such as block and tackle devices, grapples, and the like, without departing from the teachings of the present invention. Once set up, the jib crane, and hence the boom which is connected thereto, is horizontally rotatable about a vertical axis formed by the mast centerline 59.

Figure 3:
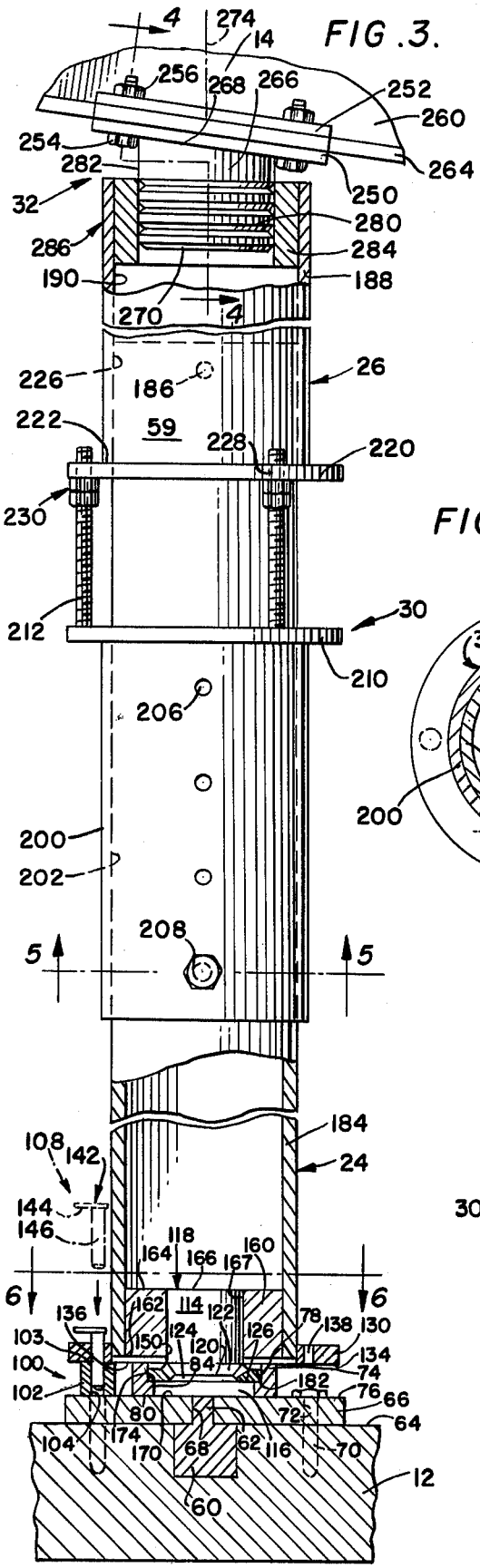
FIG. 3 is an elevation view taken along line 3—3 of FIG. 2.

The base element 22 is best shown in FIG. 3, and includes an anchor 60 embedded in the floor 12 and having a seating projection 62 extending upwardly beyond the floor surface 64. A generally circular floor plate 66 having a central bore 68 defined therthrough is attached to the floor by a plurality of floor bolts 70 extending through bolt receiving holes 72 so that projection 62 is received in bore 68, thereby forming a mortise-tenon joint between these two elements.

A circular collar 74 is mounted on upper surface 76 of the floor plate to be essentially co-axial therewith and to surround the projection receiving bore 68. The collar has a top rim 78 and a bottom peripheral edge 80 seated on the floor plate upper surface. The bottom edge is formed by an inturned shoulder 84 of the collar.

A rotation arrester 100 is also mounted on the upper surface of the floor plate. The rotation arrester includes a tubular member 102 having a lower end thereof mounted on surface 76 and the other end 103 thereof presented upwardly thereof. An axial bore 104 extends the length of the tubular member 102 and is aligned with one of the plurality of bolt receiving holes 72. A rotation arresting member 108 is received in axial bore 104 to prevent rotation of the crane 10 about the longitudinal axis thereof.

A rotation boss 114 includes a head 116 received in the annulus defined by the inner edge of the inturned shoulder 84 of the collar 74, and an upwardly presented, generally cylindrical body 118 connected thereto by a neck portion 120. The neck portion is formed by a downwardly directed conical portion 122 on the lower end of the body 118, and an upwardly directed conical portion 124 mounted on upper surface 126 of the head 116. The body 118 extends above the plane of the collar rim 78 which is essentially co-planar with the end 103 of the tubular member 102.

The lower end of the mast bottom section 24 has an annular flange 130 integral therewith and surrounding that section so that lower surface 134 of the flange is essentially co-planar with the lower end 136 of the botom section. The flange 130 has a plurality of bolt receiving holes 138 defined therethrough. The holes are located on the flange so that at least one of them can be aligned with the axial bore 104 of the tubular member 102. The rotation arresting member, such as pin 142 having a head 144 and a body 146, is received through the flange hole and fits into the tubular member axial bore. As the tubular member is fixedly mounted on the floor plate, and the flange is fixedly secured to the bottom section 24, relative rotation between these two members is prevented by the member 108.

The flange 130 has a central opening 150 which has a diameter essentially equal to, but slightly larger than, the diameter essentially equal to, but slightly larger than, the diameter of the cylindrical body 118 so that body is received therethrough, while lower surface 134 of the flange rests on and is supported by the co-planar upper rims 103 and 78 of the tubular member 102 and the collar 74, respectively. Therefore, the vertical standard of the mast rests on those just-discussed members in a slidable manner, as will be explained below.

An annular boss-receiving plug 160 is mounted inside of the bore defined in lower section 24 at the lower end thereof to extend from the top surface 162 of the flange 130 inwardly of the tubular section 24 to a location whereat the inner end 164 of the plug is essentially co-planar with inner end 166 of the boss body 118. The plug has an axial bore 167 defined therethrough which has a diameter essentially equal to, but slightly greater than, the diameter of the body 118 to receive same in a rotation permitting manner. The plug serves as an additional support member for the mast.

The head 116 has a lower surface 170 contacting top surface 76 of the floor plate and has a thickness selected so that a top surface 126 thereof is essentially co-planar with top surface 174 of the collar shoulder 84. The two co-planar surfaces 126 and 174 combine to form a bearing seat on which bearing means 182 rest. The bearings can be roller bearings, thrust bearings, or any other suitable bearings, and contact the boss body 118 at conical section 122. The mast is therefore rotatably mounted on the floor by the bearing means retained in the collar 74, as shown in FIG. 3. The downward thrust of the mast is taken up partially by the plug 160 and flange 130 which slidably rest on the rims 78 and 103, and partially by the bearing means 182 which rests on the bearing seat and contacts the rotation boss 114 at neck portion 120 thereof.

The elements mounted on surface 76 of the floor plate can be secured thereto by welding, or other suitable means.

The bottom section 24 extends upwardly from the base element 22 and has a generally tubular body 184 having a plurality of longitudinally spaced apart holes 186 defined therein. The holes 186 are directed radially of the tubular bottom section and are part of a height adjusting means, and will be discussed in greater detail below. The upper section 26 also has a tubular body 188 and has an axial bore 190 defined therethrough. The outer diameter of the tubular body 184 is slightly less than the diameter of bore 190 of the body 188, so that section 24 is insertably received within the axial bore 190 of the upper section 26. The height of the mast is adjusted using this telescoping feature.

Figure 5:
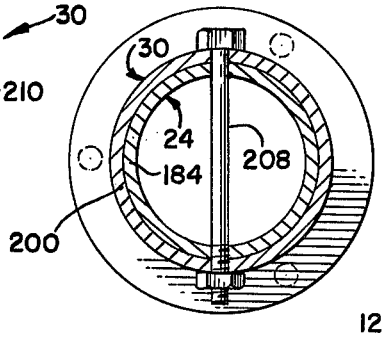
FIG. 5 is a plan view taken along line 5—5 of FIG. 3.
Figure 6:
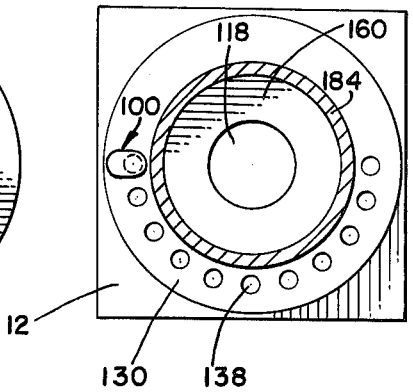
FIG. 6 is a plan view taken along line 6—6 of FIG. 3.

The adjustment member 30 is shown in FIGS. 1 and 3 and includes a tubular jacket 200 having an axial bore 202 defined therethrough. The axial bore 202 has a diameter slightly larger than the outer diameter of the bottom section 24 so the bottom section can be insertably received by the jacket 200. The jacket has a plurality of longitudinally spaced apart bolt receiving holes 206 defined therein to be radially directed thereof and which are alignable with holes 186 on the bottom section 24. A lock pin 208 is received in aligned holes to lock the adjustment member to the bottom section 24. As shown in FIG. 5, the lock pin 208 is a bolt having external threads on one end and a bolt head on the other end. The threads are received in a nut in the usual manner to secure a bolt in the aligned holes. In one embodiment, the holes 186 and 203 are on three inch centers, and there are at least three holes in each set of the aforementioned one embodiment.

One end of the adjustment member has an annular flange 210 integrally fixed thereto to surround same. The flange has a plurality of bolts 212 integrally attached thereto to extend upwardly from the flange when the jacket is connected onto the bottom section 24. The flange has a central bore defined therein having a diameter essentially equal to the diameter of the bore 202 of the jacket 200 so that the upper section 26 can be received therethrough.

A cooperating annular flange 220 is fixedly attached to the one end 222 of the upper section 26 to be presented toward flange 210 when the bottom section 24 is received in axial bore 226 extending through section 26. A plurality of bolt receiving holes 228 are defined in the flange 220 and each have bolt locking means, such as nuts 230, located circumjacent thereto to receive bolts 212 in a locking manner. The nuts are welded or otherwise fixed to the flange in a non-rotatable manner.

With bolts 212 locked in nuts 230, and lock pin 208 inserted into aligned holes 206 and 186, the upper mast section 26 is supported on the lower mast section 24 which, in turn, is supported on the floor by base element 22.

The lock pin-aligned holes serve as a rough adjustment for the mast height, and by taking up the nuts 230 on the bolts 212, a fine height adjustment can be effected.

Figure 4:
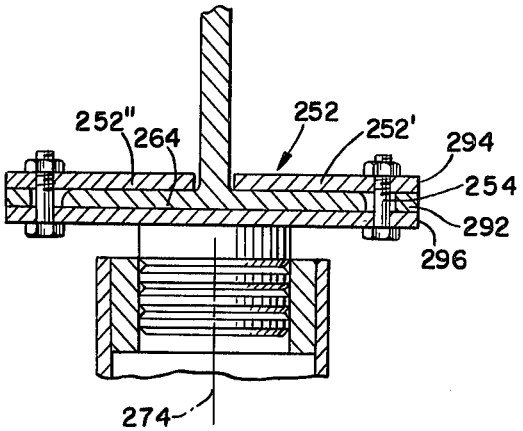
FIG. 4 is an elevation view of a ceiling mounting taken along line 4—4 of FIG. 3.

The top element 32 is best shown in FIGS. 1, 3 and 4 and includes a pair of facially opposed clamp plates 250 and 252 connected together by connecting means, such as bolts 254 and nuts 256. The ceiling element 14 is shown in the figures as being a conventional I-beam having a web 260 connecting a pair of flange elements 262 and 264 together. The flange element 264 is the lower flange element in FIG. 3 and is interposed between plates 250 and 252 with the bolts extending through holes defined in that web to fixedly secure the elemnt 32 to the ceiling element.

A cylindrical boss element 266 is tetragonally shaped in cross-section and has one end 268 fixed to plate 250 and end 270 spaced apart therefrom. As shown in FIG. 3, the end 268 is canted with respect to axial centerline 274 of the boss, so the boss centerline is oriented to be aligned with centerline 59 of the mast, even though the ceiling element is sloped with respect to that mast centerline. The boss includes external grooves 280 defined in the outer surface 282 thereof, and an annular bushing member 284 is mounted in upper end 286 of the mast section 26 for cooperable association with the boss element. The bushing has an axial bore therethrough and has internal grease grooves defined in that axial bore to be complemental with the external grooves 280 for receiving the boss element 266 and attaching that element to the mast. The association between the boss and the bushing occurs when the boss is inserted into the bore of the bushing, as shown in FIG. 3. The weight of the structure is supported at the bottom by element 22. The height of the mast can be adjusted by selecting suitable aligning holes of the holes 186 and 206, and adjusting the take-up of the nuts 230 on bolts 212 of the adjustment member 30.

As shown in FIG. 4, the top clamp plate 252 is formed of a pair of identical sections 252′ and 252″, each of which is attached to a flange of the I-beam. The outer longitudinal edge of the I-beam flange 264 is located between the centerline of the lower clamp plate 250 and the bolt 254. A spacer member 292 is located adjacent the longitudinal edges 294 and 296 of the plate members 250 and 252, respectively.

An alternative embodiment of the ceiling element 32 would have a boss element depending in an essentially perpendicular manner from the lower plate 250. Such an embodiment is used with non-sloping ceiling elements.

Figure 7:
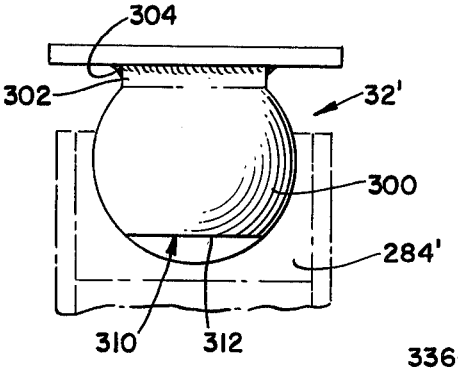
FIGS. 7 and 8 show alternative embodiments of the ceiling mounting.
Figure 8:
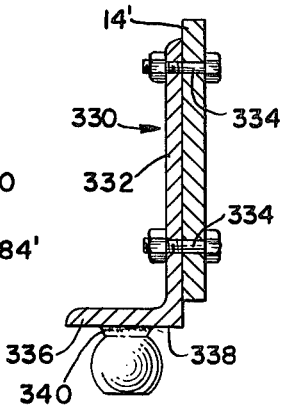

The FIG. 7 embodiment of the ceiling element 32 is denoted by the numeral 32′ and includes a knob 300 in place of the boss 266. The knob is essentially spherical and has a neck 302 which is attached, as by weldment 304, to a ceiling member. A bushing 284′ is positioned in the upper end of the mast upper section and has an internal shape complemental with the spherical shape of the knob. The knob and bushing of the FIG. 7 embodiment thus form a ball and socket joint to permit universal movement of the mast thereabout. The bushing 284′ can have a bottom section which contacts the bottom section 310 of the knob, or can be hollow, as desired. Alternatively, the knob can have a flat surface 312, such as shown in FIG. 8, in which case, the socket would be complementally shaped with the flat portion therein. Further alternatively, the flat knob can be used with an essentially spherical socket, in which case, the differently shaped structures can be used to adjust the amount of rotatable movement undergone by the mast.

When desired, a projection can be fixed onto flat surface 312 of the knob to depend therefrom into a cooperating slot defined in the boss receiving socket or bushing. The projection can have curved ends, and the slot can also be curved at the ends thereof so the mast can be tipped in one plane, but is prevented from moving in a plane perpendicular thereto.

A means of connecting the ball-shaped boss to a ceiling element is shown in FIG. 8, and includes a bracket 330 having a vertical leg 332 bolted to a ceiling member 14′ by bolts 334 and a horizontal leg 336 with the ball-shaped boss fixed thereto at undersurface 338 by a weldment 340, or the like.

The installation of the jib crane 10 is evident from the above description, and accordingly, will only be presented in a broad manner. A thrust hole, which receives the anchor 60, is drilled in the floor at the appropriate, preselected location. Bolt holes are drilled in the floor circumjacent that thrust hole, the ancor is embedded in the floor, and the floor plate is bolted to the floor. The collar and tubular members are positioned on the floor plate, and the rotation boss and bearing means are assembled with the floor plate. The bottom mast section is positioned on the rotation boss and the rotation arresting pins are inserted through the flange holes.

According to preselected measurements, the ceiling element 32 is positioned above the just-assembled base element, and the adjustment means 30 is positioned on the lower mast section. The upper mast section is connected to the ceiling element via the top element 32. The adjustment means 30 is then connected to the mast and the flanges 210 and 220 are connected together by the bolts 212 which are taken up on nuts 230 to make the final height adjustments.

The boom is then attached to the mast in the usual manner, and the trolley is positioned thereon, also in the usual manner. The hoist is then connected to the carriage, and the crane is operatively set up. Of course, the mast is pivotally adjustable to rotate the boom into the proper position.

Alternatively, the upper mast section can be positioned on, and connected to, the lower mast section by the adjustment means 30 and lifted into contact with the ceiling elements 32 by means of the bolts 212. Thus, the mast sections would be connected, and the bolts 212 turned with respect to the nuts 230 until the bolts have forced the upper mast section against the ceiling element 32.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A jib crane comprising:

a base element mounted on a floor, said base element including an anchor embedded in the building floor, a floor plate mounted on the building floor and fixed to said anchor, an annular collar having a top rim and a bottom rim fixed to said floor plate to be coaxial with said anchor, a rotation boss seated in the annulus defined in said annular collar;

a lower tubular mast section having a mounting flange fixed to one end thereof, and a bearing surface on said lower mast section one end receiving said rotation boss, said mounting flange having a lower surface resting on said base element annular collar top rim, said lower mast section having a plurality of fastener receiving holes defined therein, said fastener holes being spaced apart longitudinally of said lower mast section;

an upper tubular mast section telescopingly receiving said lower section in one end thereof; said mast sections being longitudinally aligned and essentially upright;

a top element connecting the other end of said upper section to a ceiling in a manner such that said upper section is freely rotatable about the longitudinal axis thereof, said top element including ceiling slope accommodating means for connecting said upright upper mast section to a ceiling which slopes with respect to said mast sections;

connecting means connecting said mast sections together, said connecting means including a rough crane height adjustment means which comprises a tubular jacket telescopingly receiving the other end of said lower mast section and having a plurality of fastener receiving holes defined therein to be spaced apart longitudinally on said tubular jacket, and a fastener fitting through said fastener receiving holes and coupling said tubular jacekt to said lower mast section in a manner which prevents rotation of said coupled elements with respect to each other thereby further preventing rotation of said upright upper mast section with respect to said top element, and a fine crane height adjustment means which comprises a first flange on said tubular jacket, a second flange mounted on said upper mast section one end and having a plurality of bolt receiving openings defined therein, said flanges being facially opposed, a plurality of bolts mounted on said first flange and received in said second flange bolt receiving openings, said bolts preventing rotation of said upper mast element with respect to said tubular element so that said mast sections are coupled together in a non-rotatable manner by said connecting means, and a locking nut threaded onto each bolt and engaging said second flange, said flanges being separated by a distance determined according to the position of said locking nuts on said bolts so that the height of the crane is adjustable via said fine adjustment means independent of a crane height adjustment via said rough adjustment means and with said mast sections being non-rotatably connected together by said connecting means and load handling means connected to one of said most sections to move a load horizontally and vertically.

2. The jib crane of claim 1, wherein said mast has an upper section connected to the building ceiling element and a lower section mounted on the building floor.

3. The jib crane of claim 2, wherein said ceiling mounting means includes a mounting plate connected to a ceiling element, a fastening means connected to said mounting plate and depending therefrom, and a bushing in one end of said upper mast section adapted to receive said fastening means to connect said upper mast section to the ceiling element.

4. The jib crane of claim 3, wherein the ceiling element is an I-beam and said mounting plate is connected to one flange of the I-beam, and further including a second mounting plate connected to said I-beam flange and fastening members connecting said mounting plates together and to said I-beam flange.

5. The jib crane of claim 4, further including another mounting plate on another flange of the I-beam.

6. The jib crane of claim 4, further including a spacer member interposed between said mounting plate and said second mounting plate.

7. The jib crane of claim 2, wherein said ceiling mounting means includes a knob mounted on the ceiling element and said mast upper section has a bushing in one end thereof shaped to receive said knob to form a ball and socket connection to the building ceiling element.

8. The jib crane of claim 7, further including a bracket connecting said knob to the building ceiling element.

9. The jib crane of claim 2, further said load handbag means includes a boom having one end connected to said upper mast section and a tie rod having one end connected to said upper mast section and the other end thereof connected to the other end of said boom.

10. The jib crane of claim 9, wherein said boom includes a beam having a girder cross-section and a trolley mounted for horizontal movement along said boom.

11. The jib crane of claim 10, wherein said trolley includes a carriage mounted on said boom and a hoist connected to said carriage.

12. The jib crane of claim 2, wherein said lower mast section is telescopingly received in said upper mast section.

13. The jib crane of claim 2, further said load handling means includes a boom arm connected at one end thereof to said upper mast section.

14. The jib crane of claim 13, further including a tie rod connecting the other end of said boom arm to said mast upper section.

15. The jib crane of claim 2, wherein said mast sections are tubular and said height adjustment means includes a tubular body telescopingly receiving said lower mast section, a first flange fixedly connected to one end of said tubular body, a second flange fixedly connected to one end of said upper mast section, first connecting means on said flanges for releasably connecting said flanges together, and second connecting means releasably connecting said tubular body to said lower mast section.

16. The jib crane of claim 15, wherein said tubular body and said lower mast section each have a plurality of longitudinally spaced apart alignable holes defined therein and said second connecting means includes a bolt inserted into aligned holes on said lower mast section and said tubular body.

17. The jib crane of claim 1 wherein said bearing surface includes a bushing mounted in said lower mast section.

18. The jib crane of claim 17, further including a mast rotation arrester including a tubular body having one end mounted on said floor plate and the other end slidably engaged against said mounting flange lower surface, said body having an axial bore defined therethrough, said mounting flange having a plurality of holes defined therethrough to be alignable with said tubular body bore, and a connecting pin insertable through the holes defined in said mounting flange and into said tubular body bore to lock said mast to said floor plate.

19. The jib crane of claim 17, further including bearings located adjacent said rotation boss in said collar.

20. The jib crane of claim 1, wherein said mast has a longitudinal centerline and said mast is rotatable about said longitudinal centerline.

* * * * *